US008978676B2

(12) United States Patent
Williams

(10) Patent No.: US 8,978,676 B2
(45) Date of Patent: Mar. 17, 2015

(54) UMBRELLA STAND

(71) Applicant: Walter Williams, Los Angeles, CA (US)

(72) Inventor: Walter Williams, Los Angeles, CA (US)

( * ) Notice: Subject to any disclaimer, the term of this patent is extended or adjusted under 35 U.S.C. 154(b) by 0 days.

(21) Appl. No.: 14/260,102

(22) Filed: Apr. 23, 2014

(65) Prior Publication Data

US 2014/0311536 A1 Oct. 23, 2014

Related U.S. Application Data

(60) Provisional application No. 61/815,166, filed on Apr. 23, 2013.

(51) Int. Cl.
*A45B 3/00* (2006.01)
*F16M 13/00* (2006.01)
*E04H 12/22* (2006.01)

(52) U.S. Cl.
CPC ..... *E04H 12/22* (2013.01)
USPC ..... 135/16; 135/98; 248/511; 248/519; 248/156

(58) Field of Classification Search
USPC ..... 135/15.1, 16, 98, 118; 248/511, 518, 248/519, 530, 156
See application file for complete search history.

(56) References Cited

U.S. PATENT DOCUMENTS

| | | | | | |
|---|---|---|---|---|---|
| 3,225,656 | A * | 12/1965 | Flaherty et al. | 89/37.04 |
| 4,753,411 | A * | 6/1988 | Lechner et al. | 248/533 |
| D364,048 | S * | 11/1995 | Winslow, Sr. | D6/417 |
| 6,088,946 | A * | 7/2000 | Simmons | 43/15 |
| 6,305,659 | B1 * | 10/2001 | Metelski | 248/519 |
| 6,888,512 | B1 * | 5/2005 | Daigler | 343/878 |
| 6,953,180 | B1 * | 10/2005 | Ruvalcaba et al. | 248/530 |
| 2003/0094559 | A1 * | 5/2003 | Krinner | 248/523 |
| 2006/0006306 | A1 * | 1/2006 | Wadsworth | 248/511 |
| 2008/0017226 | A1 * | 1/2008 | Nobert et al. | 135/16 |
| 2011/0180679 | A1 * | 7/2011 | Ma | 248/346.01 |

* cited by examiner

*Primary Examiner* — Winnie Yip
(74) *Attorney, Agent, or Firm* — Cislo & Thomas, LLP

(57) ABSTRACT

An umbrella holder having a base, a holder removably attachable to the base, and a plurality of stakes to secure the base to the ground. A top surface of the base has a section to store the holder when not in use. A bottom surface of the base has a plurality of stake holders to hold the stakes when not in use. The holder has two tubes attached by link arms to allow the two holders to be adjustable relative to each other. The base also has a central main hole and a plurality of auxiliary holes so that a pole can be inserted through at least one of the tubes and through the main hole so as to be perpendicular to the ground, or through one of the auxiliary holes so as to be non-perpendicular to the ground.

13 Claims, 4 Drawing Sheets

UMBRELLA STAND

CROSS-REFERENCE TO RELATED APPLICATIONS

This patent application claims priority to U.S. Provisional Patent Application No. 61/815,166 filed Apr. 23, 2013 for Umbrella Stand, which application is incorporated herein by this reference thereto.

TECHNICAL FIELD

This invention relates to a stand to hold beach umbrellas and the like.

BACKGROUND

Going to the beach or playing at the park is a cost-effective way to spend time with the family or enjoy a relaxing day. Unfortunately, the beaches and sometimes the parks lack sufficient shading to avoid sunburns caused by the sun. Many people bring beach umbrellas. However, the beach umbrellas are difficult to drive into the sand or grass to provide sufficient support to keep the beach umbrella upright. The sand may be too soft to keep the umbrella. standing. The grass may be too tough to drive the umbrella deep enough into grass to keep it standing.

Therefore, there is a need for an umbrella stand that can be used at a variety of places, such as the park or the beach, that is easy to set up, stable, and versatile enough to change the angle of the umbrella as the sun shifts.

SUMMARY

The present invention is directed to an umbrella stand that is easy to use, easy to transport, and easy to store. The umbrella stand comprises a base, a holder, and a plurality of stakes. When not in use, the holder and stakes can be attached to the base in an efficient and compact manner for storage purposes. The holder can be adjustable to allow the umbrella to be positioned at various angles.

DETAILED DESCRIPTION OF THE INVENTION

The detailed description set forth below in connection with the appended drawings is intended as a description of presently-preferred embodiments of the invention and is not intended to represent the only forms in which the present invention may be constructed or utilized. The description sets forth the functions and the sequence of steps for constructing and operating the invention in connection with the illustrated embodiments. It is to be understood, however, that the same or equivalent functions and sequences may be accomplished by different embodiments that are also intended to he encompassed within the spirit and scope of the invention.

Figure 1:
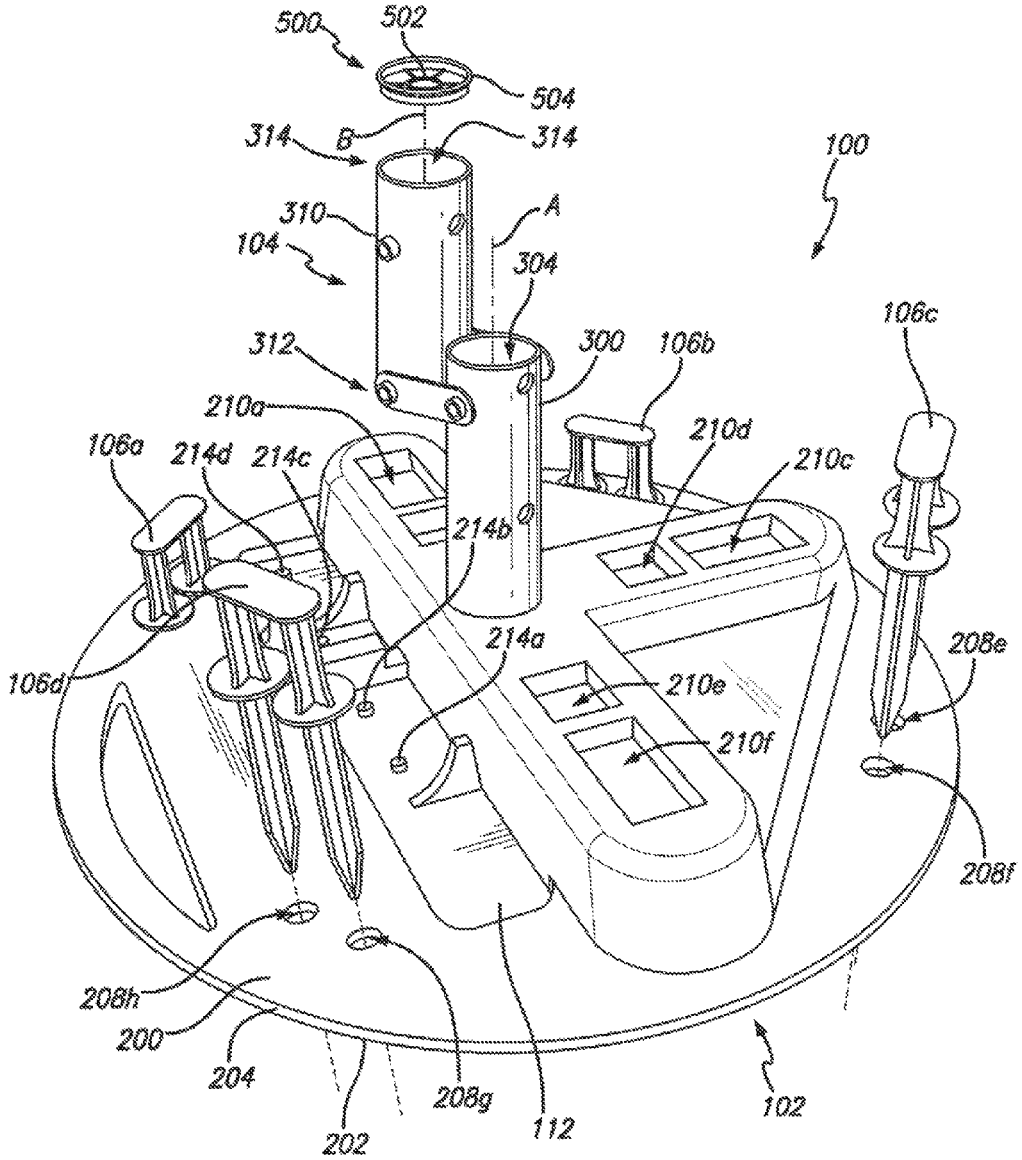
FIG. 1 shows a perspective top view of the present invention, with the two back stakes fully inserted into the holder, the two front stakes aligned to be inserted into the holder, and the insert aligned to be inserted into an opening of the cylindrical tube.
Figure 2:
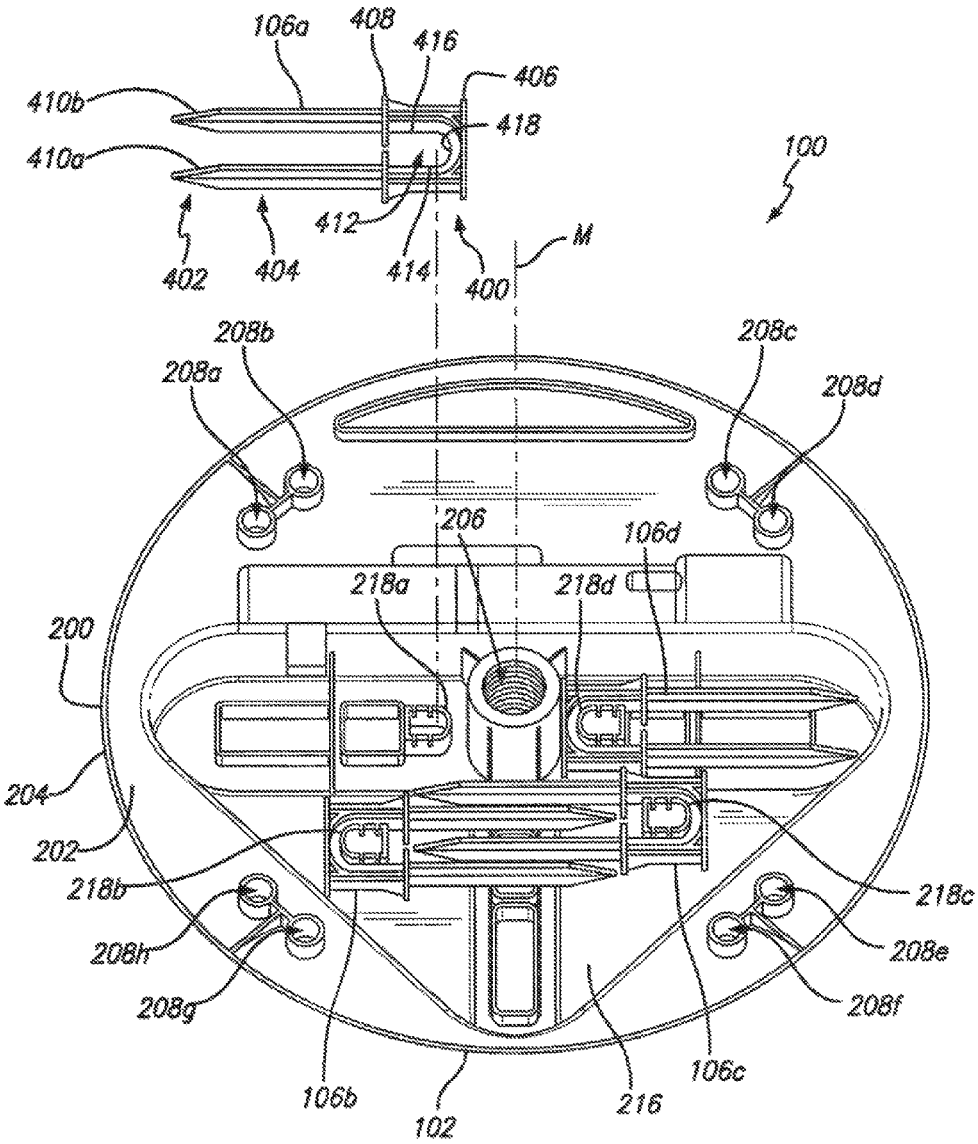
FIG. 2 shows a perspective bottom view of the present invention, with some of the stakes stowed away.
Figure 3:
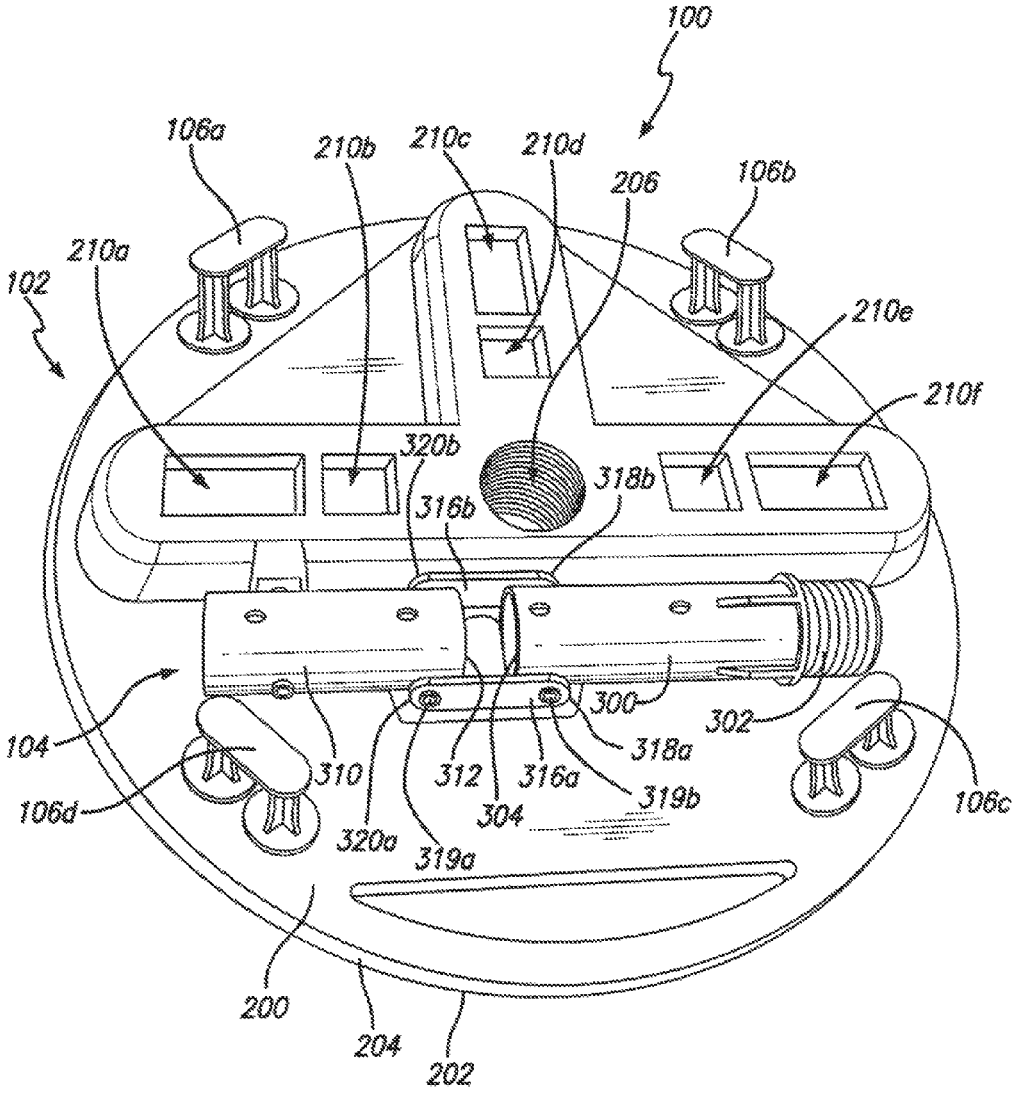
FIG. 3 shows a perspective top view of the present invention, with the holder stowed away.

The invention of the present application is an umbrella stand 100 for oversized umbrellas, such as beach umbrellas, that is easy to set up, easy to transport, and easy to store. As shown in FIGS. 1 through 3, the umbrella stand 100 comprises a base 102, a holder 104, and a plurality of stakes 106*a-d*. The base 102 provides the foundation to provide support for the umbrella. The holder 104 connects to the base 102 and holds the umbrella on the base 102 in various orientations. The plurality of stakes 106*a-d* adds additional securement for the base 102.

In the preferred embodiment, the base 102 is circular in shape having a top surface 200 and a bottom surface 202 opposite the top surface 200, and the top and bottom surfaces 200, 202 are bound by an outer perimeter 204. The base 102 comprises a main hole 206 at the center, a plurality of stake holes 208*a-h* along and adjacent to the outer perimeter 204 of the base 102, and a plurality of auxiliary holes 210*a-f* adjacent to the main hold 206. A main axis M passes through the center of the main hole 206, perpendicular to the top and bottom surfaces 200, 202. The main hole 206 may be threaded. The plurality of stake holes 208*a-h* may be intermittently and evenly spaced along and adjacent to the outer perimeter 204 of the base 102. The plurality of stakes 106*a-d* may be inserted into the plurality of stake holes 208*a-h* to secure the base 102 to the ground, such as in the grass or sand. The plurality of auxiliary holes 210*a-f* may be positioned adjacent to the main hole 206 for reasons discussed below. The top surface 200 further comprises a channel 212 with a plurality of protruding pegs 214*a-d*. The plurality of protruding pegs 214*a-d* may be used to secure the holder 104 when not in use, as shown in FIG. 3.

The bottom surface 202 comprises a recessed portion 216. The recessed portion 216 causes the top surface 200 to have an elevated portion to accommodate the recessed portion 216. Within the recessed portion 216 may be a plurality of stake holders 218*a-d*. The plurality of stake holders 218*a-d* may be used to secure the plurality of stakes 106*a-d* when not in use, as shown in FIG. 2. The plurality of stake holders 218*a-d* may be any type of fastener, such as a clip, hook, adhesive, strap, elastic band, resistance-fit protuberance, and the like. In the preferred embodiment, the plurality of stake holders 218*a-d* may be protuberances that project from the recessed portion 216. More preferably, the plurality of the stake holders 218*a-d* may be C-shaped protuberances. In the preferred embodiment, the plurality of the stake holders 218*a-d* that are C-shaped protuberances are designed to match C-shaped gaps 412 of the plurality of stakes 106*a-d* to secure the plurality of stakes by resistance fit or clips. The C-shaped gaps 412 are discussed below. More preferably, the plurality of stake holders 218*a-d* are strategically arranged within the recess to allow for efficient storage of the plurality of stakes 106*a-d* within the recess 216 as shown in FIG. 2.

The holder 104 comprises a main cylindrical tube 300 defining a first axis A. The main tube 300 has a proximal end 302, a distal end 304 opposite of the proximal end 302, and openings on both ends. In the preferred embodiment, the proximal end 302 may be threaded to screw into the main hole 206. An umbrella could be inserted into the holder 104 to support an umbrella in an upright configuration parallel to and coaxial with the main axis M.

Oftentimes the user would like to be able to adjust the angle of the umbrella as the sun moves. To permit the umbrella to be inserted at an angle, the holder 104 may comprise a secondary cylindrical tube 310 attached to the main tube 300. The secondary tube 310 defines a second axis B. The secondary tube 310 has a connectable end 312 and a free end 314. The secondary tube 310 may be movably connected to the main tube 300 via a pair of link arms 316*a,b*. Each link arm 316*a,b* has a first end 318*a,b* and a second end 320*a,b*. The first end 318*a,b* of each link arm is rotatably connected to the main tube 300 at its distal end 304. The second end 320*a,b* of each link arm 316*a,b* is rotatably connected to the connectable end 312 of the secondary tube 310. This rotatable linkage of the main tube 300 to the secondary tube 310 allows the secondary tube 310 to be adjusted relative to the main tube 300. In the preferred embodiment, the secondary tube 310 can be adjusted relative to the main tube 300 such that the second axis B can be coaxially aligned with the first axis A or positioned at any angle between 0 and 180 degrees, relative to the first axis A.

Each of the plurality of stakes 106*a-d* can be any kind of sturdy rod having a top 400, a bottom 402, and a middle portion 404 there between. In the preferred embodiment, each of the plurality of stakes 106*a-d* tapers into a sharp point at the bottom 402. The top 400 may have a flat head 406 so that the stake can be pounded into the ground. In the preferred embodiment, a stop 408 is positioned on the middle portion 404, closer to the top 400 than the bottom 402. The dimensions of each of the plurality of stakes 106*a-d* are such that it can be inserted into the stake holes 208*a-h*. The stop 408 prevents each of the plurality of stakes 106*a-d* from being inserted too deep into the stake holes 208*a-h*, which would make it difficult or inconvenient to pull out each of the plurality of stakes 106*a-d*. In the preferred embodiment, a pair of stake prongs 410*a*, 410*b* may he connected or formed together creating a pi-shaped, two-prong stake (π) 106*a-d*. In such an embodiment, the stake holes 208*a,b*; 208*c,d*; 208*e,f*; 208*g,h* are arranged in pairs so that each prong 410*a*, 410*b* of the two-prong stake embodiment can be inserted simultaneously into one of the pairs of stake holes 208*a,b*; 208*c,d*; 208*e,f*; 208*g,h*. Having two prongs, the stake heads 406 of each of the plurality of the two-prong stakes 106*a-d* increase in surface area, making it easier to pound each of the plurality of stakes 106*a-d* into the ground.

The two-prong stake embodiment also creates the C-shaped gap 412 mentioned above and is defined by the inner wall 414 of the first prong 410*a*, the bottom surface 418 of the head 406, and the inner wall 416 of the second prong 410*b*. This gap 412 is designed to be substantially similar to the C-shaped protuberance 218 on the bottom surface 202 of the base 102. This allows each of the plurality of two-prong stakes 106*a-d* to be secured to the protuberances 218 via resistance fit. In some embodiments, the protuberances 218 may each have a small lip to catch the stakes 106 in the C-shaped gap 412. The C-shaped protuberances 218 are strategically arranged so that the stakes 106 can be efficiently arranged within the recess 216 so as to minimize wasted space.

In some embodiments, the umbrella holder may come with an insert 500 that can be inserted into the openings 304, 314 of the cylindrical tubes 300, 310. The insert 500 comprises a narrower hole 502 than the openings 304, 314 of the cylindrical tubes 300, 310 so that the holder 104 can be used with umbrellas with thinner poles 10. The insert 500 may be a disk-like cylinder. At one end may be a flanged lip 504 to prevent the insert 500 from being lodged too deep inside the cylindrical tubes 300, 310.

In use, the user places the base 102 on the ground, such as sand or grass. The stakes 106*a-d* are driven into the stake holes 208*a-d* to secure the base 102 to the ground. The holder 104 is screwed into the main hole 206 via the main tube 300. The main tube 300 may be aligned with the secondary cylindrical tube 310 so that their axes are coaxially aligned. An umbrella is then inserted into the secondary cylindrical tube 310 through the main cylindrical tube 300 and, optionally, through the main hole 206 into the ground. In this configuration the umbrella is perfectly upright, coaxially aligned with the cylindrical tubes 300, 310, and perpendicular to the base 102.

Figure 4:
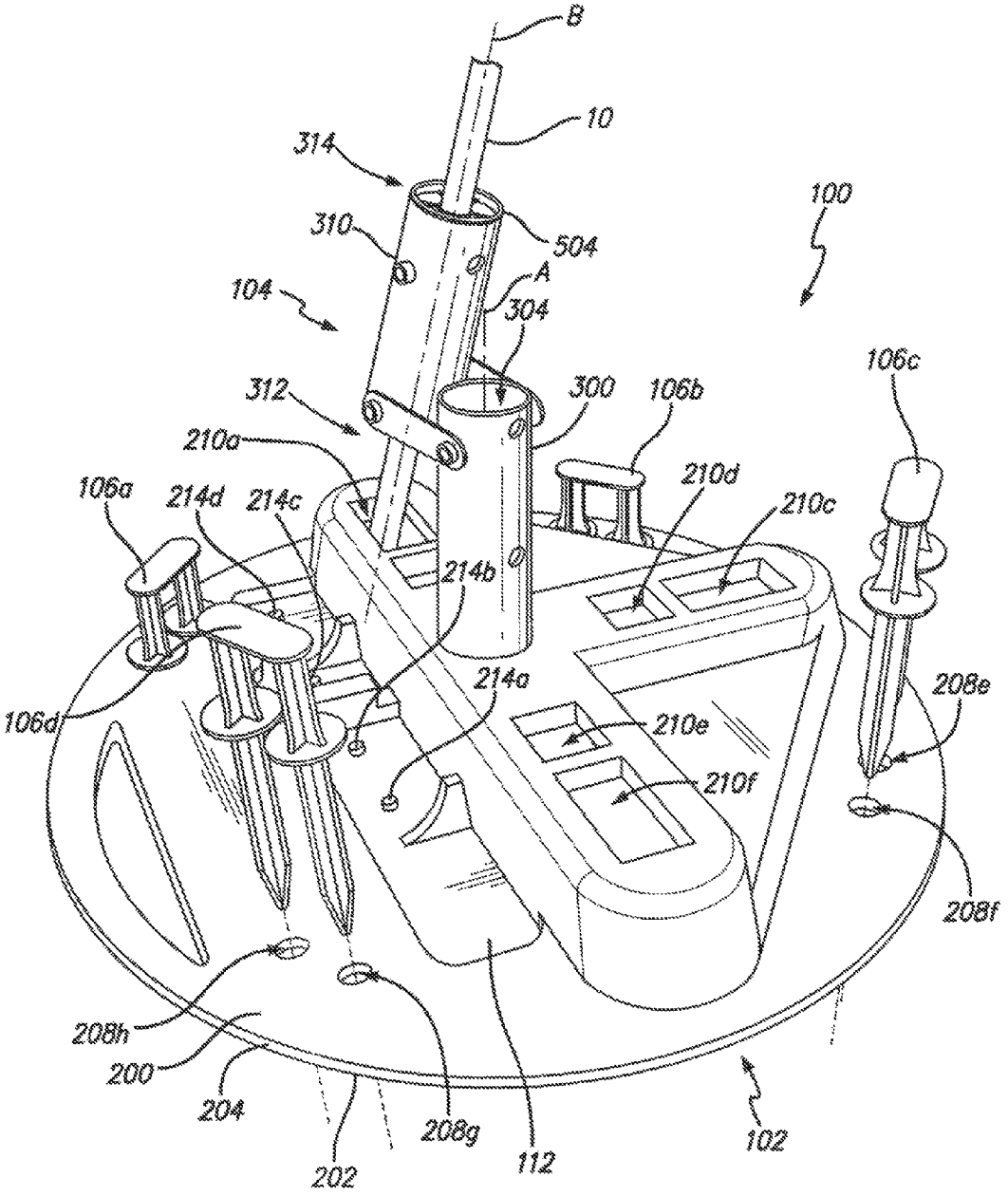
FIG. 4 shows a perspective view of the present invention in use with a pole inserted into the holder.

If the user wants the umbrella to be tilted, the user can pull the umbrella up so as to be removed from the main cylindrical tube 300 but still within the secondary cylindrical tube 310. The secondary tube 310 is then tilted by rotating the secondary cylindrical tube 310 about the pins 319*a,b* that secure the secondary cylindrical tubes 310 to the link arms 316*a,b* so that the second axis B is angled relative to the first axis A. The degree of the angle is up to the user. The user can then push the umbrella down and insert the pole 10 of the umbrella into one of the auxiliary holes 210*a-f* as shown in FIG. 4. This then secures the umbrella in an angled position.

The foregoing description of the preferred embodiment of the invention has been presented for the purposes of illustration and description. It is not intended to be exhaustive or to limit the invention to the precise form disclosed. Many modifications and variations are possible in light of the above teaching. It is intended that the scope of the invention not be limited by this detailed description, but by the claims and the equivalents to the claims appended hereto.

What is claimed is:

1. An umbrella stand, comprising;

a. a circular base, defining a center and a main axis that passes through the center of the base and is perpendicular to the base, the base comprising:
   i. a threaded main hole at the center;
   ii. a top surface and a bottom surface opposite the top surface, wherein the top and bottom surfaces are bound by an outer perimeter and the bottom surface comprises a recessed portion;
   iii. a channel formed in the top surface adjacent to the main hole with pegs protruding therefrom;
   iv. a plurality of stake holders in the recessed portion of the bottom surface;
   v. a plurality of stake holes in the base that are arranged in pairs intermittently and evenly spaced along and adjacent to the outer perimeter; and
   vi. a plurality of auxiliary holes in the base adjacent to the main hole;

b. a holder attachable to the base, the holder comprising:
   i. a main cylindrical tube defining a first axis, the main cylindrical tube comprising a proximal end attachable to the base at the main hole, a distal end opposite the proximal end, and openings on both ends; and
   ii. a secondary cylindrical tube defining a second axis, the secondary cylindrical tube comprising a connectable end, a free end opposite the connectable end, and openings on both the connectable and the free ends,
   iii. wherein the connectable end of the secondary cylindrical tube is movably attached to the distal end of the main cylindrical tube via a pair of link arms, and
   iv. wherein the link arms permit the secondary cylindrical tube to be adjustable relative to the main cylindrical tube such that the second axis can be coaxially aligned with the first axis or positioned at any angle between 0 and 180 degrees relative to the first axis;

c. a plurality of stakes that are removably connected to the base, wherein each stake of the plurality of stakes comprises a two-pronged, pi-shaped configuration with a top portion that creates a C-shaped gap defined by an inner wall of a first prong of the two-pronged stake, a bottom surface of the top portion, and an inner wall of a second prong the stake, wherein each prong of the stake is configured to be inserted into a stake hole of the plurality of stake holes, and wherein each prong of the stake tapers into a sharp point at a bottom portion, and has a stop positioned at a middle portion of the prong closer to the top portion than the bottom portion; and d. a disk-like insert that is removably connected to the holder and can be inserted into any of the openings of the holder, wherein the disk-like insert comprises a flanged lip and a narrower hole than the openings of the cylindrical tubes.

2. An umbrella stand, comprising;

a. a base defining a center and a main axis that passes through the center of the base and is perpendicular to the base, the base comprising:

i. a main hole at the center;

ii. a top surface having a channel formed in the top surface adjacent to the main hole, the channel having pegs protruding therefrom;

iii. a bottom surface opposite the top surface, the bottom surface comprising a recessed portion, the recessed portion having a plurality of stake holders, wherein the top and bottom surfaces are bound by an outer perimeter;

iv. a plurality of stake holes in the base adjacent the outer perimeter; and v. a plurality of auxiliary holes in the base adjacent to the main hole;

b. a holder attachable to the base, the holder comprising a main tube defining a first axis, the main tube comprising a proximal end, a distal end opposite the proximal end, and openings on both ends; and c. a plurality of stakes that are removably connected to the base, each stake having a top portion, a bottom portion opposite the top portion, and a middle portion therebetween.

3. The umbrella stand of claim 2, further comprising a disk-like insert having a flanged lip that is removably connected to the holder and can be inserted into any of the openings of the holder, wherein the disk-like insert comprises a narrower hole than the opening of the cylindrical tubes.

4. The umbrella stand of claim 2, wherein the plurality of stake holes are arranged in pairs and intermittently and evenly spaced along the outer perimeter.

5. The umbrella stand of claim 2, wherein each stake holder is a C-shaped protuberance projecting from the recessed portion.

6. The umbrella stand of claim 5, wherein the stake is configured as a pi-shaped, two-pronged stake, wherein the top portion creates a C-shaped gap, wherein the gap is defined by an inner wall of a first prong, a bottom surface of a head, and an inner wall of a second prong, wherein the C-shaped protuberance is configured to mate with the C-shaped gap.

7. The umbrella stand of claim 2, wherein each stake has a stop positioned on a portion of the stake closer to the top portion than the bottom portion.

8. The umbrella stand of claim 2, further comprising a secondary tube defining a second axis, the secondary tube comprising a connectable end, a free end opposite the connectable end, and openings on both the connectable and the free ends, wherein the connectable end of the secondary tube is movably attached to the distal end of the main tube via a pair of link arms, and wherein the link arms permit the secondary tube to be adjusted relative to the main tube such that the second axis can be coaxially aligned with the first axis or positioned at any angle between 0 and 180 degrees relative to the first axis.

9. A method of holding an umbrella, comprising:

a. placing an umbrella stand on a ground, the umbrella stand comprising:

i. a base defining a center and a main axis that passes through the center of the base and is perpendicular to the base, the base comprising a main hole at the center; a top surface having a channel formed in the top surface adjacent to the main hole, the channel having pegs protruding therefrom; a bottom surface opposite the top surface, the bottom surface comprising a recessed portion, the recessed portion having a plurality of stake holders, wherein the top and bottom surfaces are hound by an outer perimeter; a plurality of stake holes in the base adjacent the outer perimeter; and a plurality of auxiliary holes in the base adjacent to the main hole;

ii. a holder attachable to the base, the holder comprising a main tube defining a first axis, the main tube comprising a proximal end, a distal end opposite the proximal end, and openings on both ends; and iii. a plurality of stakes that are removably connected to the base, each stake having a top portion, a bottom portion opposite the top portion, and a middle portion therebetween;

b. inserting the stakes into the ground through their respective stake hole;

c. attaching the holder to the base at the main hole; and d. inserting an umbrella through the main tube.

10. The method of claim 9, wherein the holder further comprises a secondary tube defining a second axis, the secondary tube comprising a connectable end, a free end opposite the connectable end, and openings on both the connectable and the free ends, wherein the connectable end of the secondary tube is movably attached to the distal end of the main tube via a pair of link arms, and wherein the link arms permit the secondary tube to be adjusted relative to the main tube such that the second axis can be coaxially aligned with the first axis or positioned at any angle between 0 and 180 degrees relative to the first axis.

11. The method of claim 10, further comprising the step of inserting the umbrella through the secondary tube, then through an auxiliary hole and into the ground.

12. The method of claim 9, further comprising removing the plurality of stakes from the stake holder prior to inserting the stakes into the ground.

13. The method of claim 9, further comprising removing the holder from the channel prior to attaching the holder to the base.

* * * * *